United States Patent [19]

Mackin

[11] Patent Number: 4,821,699

[45] Date of Patent: Apr. 18, 1989

[54] PRESSURE DISTRIBUTION DEVICE FOR VALVE COVER

[76] Inventor: Alan Mackin, 11375 Redhill Rd., Moreno Valley, Calif. 92387

[21] Appl. No.: 152,983

[22] Filed: Feb. 8, 1988

[51] Int. Cl.[4] ..... F01L 1/46

[52] U.S. Cl. ..... 123/90.38; 123/195 C

[58] Field of Search ..... 123/90.37, 90.38, 195 C

[56] References Cited

U.S. PATENT DOCUMENTS

| | | | |
|---|---|---|---|
| 4,394,853 | 7/1983 | Lopez-Crevillen et al. | 123/195 C |
| 4,492,189 | 1/1985 | Ogawa et al. | 123/90.38 |
| 4,522,165 | 6/1985 | Ogawa | 123/195 C |

FOREIGN PATENT DOCUMENTS

| | | | |
|---|---|---|---|
| 0104512 | 8/1980 | Japan | 123/195 C |

*Primary Examiner*—Willis R. Wolfe

*Attorney, Agent, or Firm*—Plante, Strauss & Vanderburgh

[57] ABSTRACT

A pressure distributing device foe an engine valve cover is described which is adapted to fit around a valve cove and to act against the valve cover attachment flange to evenly distribute torquing pressure over the valve cover and the valve cover gasket. The device consists of an annular, substantially rigid body having a plan configuration which corresponds to the valve cover. The body fits over the valve cover body and acts against the valve cover attachement flange to distribute torquing pressure thereover.

3 Claims, 1 Drawing Sheet

PRESSURE DISTRIBUTION DEVICE FOR VALVE COVER

BACKGROUND OF THE INVENTION

The invention relates to valve covers for internal combustion engines and more particularly to a device for distributing torquing pressure on the valve cover.

FIELD OF THE INVENTION

Valve covers, which are conventionally made of a light weight mild steel sheet material, serve to enclose the valve lifters, rocker arms and valves of an internal combustion engine. Depending upon the type of engine there may be a single valve cover bolted to the engine head as in the case of an in-line engine or several valve covers in the case of a V-6 or V-8 engine, each enclosing a bank of valves. Normally, a gasket is disposed between the valve cover and the head to which it is bolted to prevent oil leakage.

Over a period of time the valve cover will tend to warp and pull away somewhat from the head producing uneven clamping pressure on the gasket and resulting in annoying oil leaks. The warping of the valve cover can be caused by several conditions such as the uneven torquing of the bolts which secure the valve cover to the head or by engine overheating. Sometimes this problem can be corrected by merely tightening the valve cover bolts, but in most cases the valve cover and/or its gasket must be replaced to correct the oil leak.

SUMMARY OF THE INVENTION

The present invention relates to a device which is adapted to fit around a valve cover and to evenly distribute torquing pressure about the valve cover to correct and to prevent warping of the valve cover so as to maintain even clamping pressure on the valve cover gasket which in many cases will eliminate the leakage of oil from the valve cover and avoid the necessity of replacing the valve cover and its gasket. The pressure distributing device of the invention may be separate from the valve cover or may be formed as an integral part of the valve cover itself. Thus, in one aspect of the invention, the pressure distributing device can be applied to older engines to correct already existing oil leaking or valve cover warping problems. In another aspect, the device, as an integral part of the valve cover, is applied as part of a new valve cover and valve cover gasket combination to prevent such oil leaks before they occur and to extend the life of the valve cover gasket.

In accordance with the invention the pressure distributing device comprises an annular substantially rigid body adapted to fit around the valve cover body and overlay the attachment flange which is defined at the bottom edge of the valve cover body. The annular body is provided with bolt passages which correspond to bolt openings in the valve cover attachment flange. The lower surface of the annular body acts against the upper surface of the valve cover attachment flange to evenly distribute torquing pressure about the attachment flange of the valve cover when the valve cover attachment bolts are torqued down. T h e advantages and features of the present invention will become apparent from the following detailed description of the invention and the drawings appended hereto.

DESCRIPTION OF THE INVENTION

Figure 1:
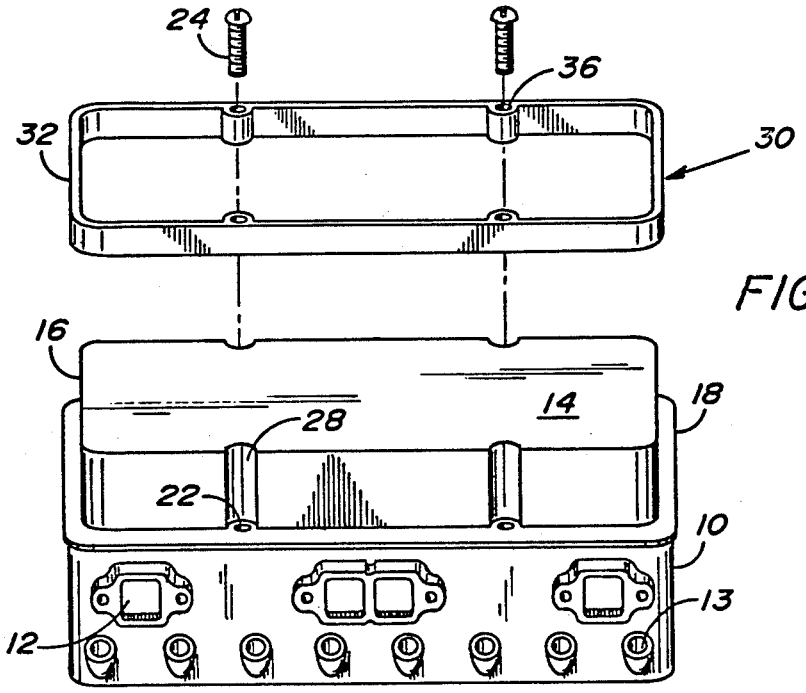
FIG. 1 is an exploded perspective view of a valve cover and head assembly and showing the pressure distributing device of the present invention.
Figure 2:
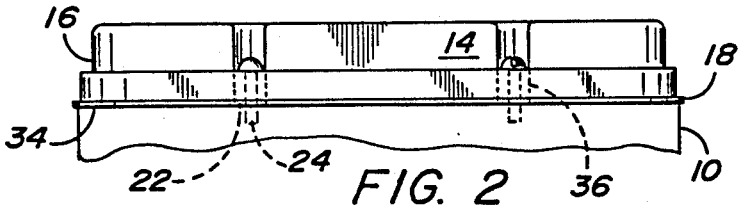
FIG. 2 is a side elevation illustrating the pressure distributing device assembled with a valve cover.

Referring to the drawings there is shown a head 10 of an automobile engine, which is provided with exhaust valve ports 12 and threaded seats 13 for spark plugs and which further includes the cylinder heads and the valves and valve linkages (not shown). A valve cover 14, which comprises a valve cover body 16 and an attachment flange 18 extending thereabout is bolted to the head 12. As is conventional, the valve cover 14 comprises relatively light weight, mild steel sheet material. A valve cover gasket (not shown) is disposed between the undersurface of the attachment flange 18 of the valve cover 14 and the head 10 to which it is bolted. The attachment flange 18 of the valve cover 14 is provide with openings 22 through each of which extends a bolt 24 which is seated in a corresponding threaded opening 26 of the head 12 and which is torqued down to secure the valve cover 14 to the head 12 and to provide, in cooperation with the valve cover gasket, an oil tight seal between the valve cover 14 and the head 12. In the embodiment illustrated, the valve cover body 16 is provided with recessed areas 28 to permit access to the heads of the bolts 24. Conventionally, each bolt 24 is torqued directly down against the upper surface of the attachment flange 18 to secure the valve cover 14 to the head 12. The valve cover gasket is clamped between the attachment flange 18 and the head 12 to provide an oil tight seal. If the bolts 24 are unevenly torqued, there will be a concentration of pressure against the attachment flange 18 by the highly torqued bolts 24 as compared to those less highly torqued. Due to the lightweight construction of the valve cover 14, over a period of time this may produce warping of the attachment flange 18 ultimately causing oil to leak from between the valve cover 14 and the head 12 of the engine 10. In addition, warping of the attachment flange 18 of the valve cover 14 can also occur due to engine 10 overheating which will likewise cause oil leaks from between the head 12 and the valve cover 14.

In accordance with the invention a pressure distributing device, shown generally as 30, comprises an annular body 32, having a plan configuration essentially the same as the plan configuration of the attachment flange 18 of the valve cover 14, is disposed around the valve cover body 16 on the upper surface of the attachment flange 18. The annular body 32 defines a planar lower face 34 which is contiguous with the upper surface of the attachment flange 18 when the device 30 of the invention is installed about the valve cover body 16. The annular body 32 is provided with bolt passages 36 corresponding in number and position to the openings 22 in the attachment flange 18 for securing the assembly of the valve cover 14 and the pressure distributing device 30 to the head 12.

Figure 3:
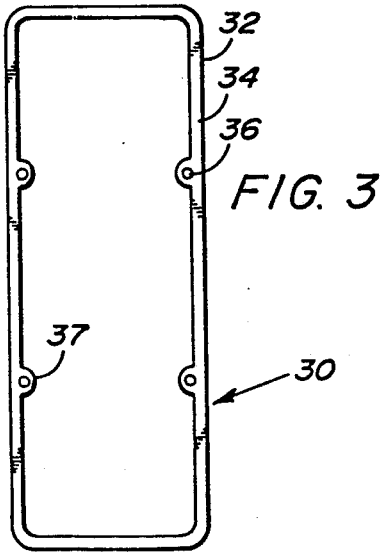
FIG. 3 is a bottom plan view of the device of FIG. 1.
Figure 4:
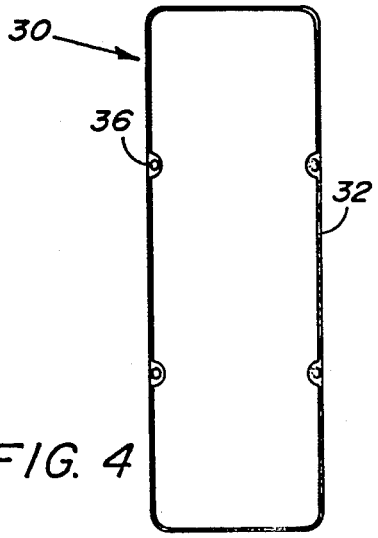
FIG. 4 is a bottom plan view of another embodiment of the device of the invention.

The annular body 32 may comprise any suitable relatively high strength material, such as, for example, mild steel, of sufficient dimension to provide the desired rigidity to the device 30. Thus, the annular body 32 may be cast, such as illustrated in FIG. 3, or may be forged or otherwise formed from mild steel strapping with the ends secured by the forging operation or by welding, such as illustrated in FIG. 4. In the embodiment illustrated in FIG. 3, the cross section of the annular body 32 at the bolt 24 openings 22 is preferably thickened by stud bosses 37 to provide more even pressure distribution directly at the torquing point of a bolt 24 and to reinforce the annular body 32 of the device 30 at the area where the bolt passage 36 is provided.

In operation, the device 30 is applied by first removing the bolts 24 which attach the valve cover 14 to the head 12 but the valve cover 14 and its gasket 20 need not necessarily be removed from the head 12. The device 30 is positioned around the valve cover body 16 and the bolts 24 are inserted through the bolt passages 36 of the device 30 and the openings 22 in the attachment flange 18 and the bolts 24 are torqued down in the conventional manner. The torquing action urges the annular body 32 against the attachment flange 18 of the valve cover 14 to exert, through its lower face 34, evenly distributed clamping pressure to the attachment flange 18 of the valve cover 14. Due to the relatively flexible nature of the attachment flange 18 of the valve cover 14, the imposition of uniform torquing pressure against the upper surface of the attachment flange 18 eliminates the uneven pressure of the flange 18 against the valve cover gasket and the head 10 due to warping or uneven torquing of the attachment flange 18 and uniform pressure between the attachment flange 18, the valve cover and the head 10 is reestablished. In this fashion, a leaking valve cover 14 can be repaired even without removing the valve cover 14 and its gasket. Although the device 30 has been described herein as a separate unit which is applied to the upper surface of the attachment flange 18 of a valve cover 14, it will be understood that the pressure distributing device 30 of the present invention can be incorporated as an integral part of a valve cover 14 so that as initially assembled, the valve cover 14 or valve covers 14 of a new engine 10 are more resistant to warping and to oil leaks thus substantially reducing the necessity or the frequency of repair work to correct such oil leaks and substantially increasing the useful life of the valve cover gasket 20. In such a case the valve cover 14 assembly comprises the valve cover 14 and an attachment flange 18 which includes a lower surface for contact with the valve cover gasket 20. The attachment flange 18 thickened or otherwise reinforced to define the substantially rigid annular body 32 which extends about the valve cover body 16 to function in the manner described above. The annular body 32 is preferably integrally formed as a part of the attachment flange 18 the valve cover 14. Also, the annular body 32 may be separately formed and affixed about the valve cover body 16 by suitable conventional means, such as by welding prior to assembling the valve cover 14 on the head 12 of an engine.

While the invention has been described in conjunction with certain preferred embodiments thereof, it should be understood that the invention may be otherwise modified without departing from the spirit and scope of the appended claims.

Having described the invention, I claim:

1. A valve cover assembly for attachment to the head of an internal combustion engine, said assembly consisting of a valve cover body, an attachment flange extending about said valve cover body, said flange including a rigid reinforcing member which extends about said valve cover body to define a lower face for contact with a valve cover gasket and bolt passages corresponding to threaded seats in said head extending from through said reinforcing member and opening at said lower face for affixing said valve cover assembly to the head of said internal combustion engine.

2. A device for evenly distributing clamping pressure over a valve cover for an internal combustion engine, said valve cover having an attachment flange extending thereabout, said attachment flange being provided with openings which correspond to threaded openings in a block of an internal combustion engine through which extend bolts by which said valve cover is attached to said block, said device comprising;

an annular, substantially rigid body defining an upper surface and a planer lower surface, said planer lower surface disposed about said valve cover and overlaying said attachment flange of said valve cover, said body including bolt passages extending therethrough and opening at said upper and said lower surfaces, said bolt passages corresponding in position and number to said openings on said attachment flange of said valve cover, said body cross section at said bolt passages being thickened with respect to the body cross section intermediate said bolt passages;

whereby said planer lower surface of said annular body acts against said attachment flange of said valve cover responsive to the down torquing of said bolts to evenly distribute clamping pressure about said attachment flange.

3. The device of claim 2 wherein said annular body in plan corresponds to the plan shape of said attachment flange of said valve cover.

* * * * *